US008476543B2

(12) United States Patent
Hart et al.

(10) Patent No.: US 8,476,543 B2
(45) Date of Patent: Jul. 2, 2013

(54) LOW PROFILE SWITCH

(75) Inventors: Roy Lynn Hart, Laguna Niguel, CA (US); Kevin Mikio Takeuchi, Tustin, CA (US)

(73) Assignee: Staco Systems, Inc., Irvine, CA (US)

( * ) Notice: Subject to any disclaimer, the term of this patent is extended or adjusted under 35 U.S.C. 154(b) by 235 days.

(21) Appl. No.: 13/102,248

(22) Filed: May 6, 2011

(65) Prior Publication Data

US 2011/0290623 A1 Dec. 1, 2011

Related U.S. Application Data

(60) Provisional application No. 61/349,200, filed on May 27, 2010.

(51) Int. Cl.
*H01H 1/00* (2006.01)

(52) U.S. Cl.
USPC ..... 200/290

(58) Field of Classification Search
USPC ..... 200/290, 5 A, 5 R, 6 R, 308–317, 200/324, 329, 341, 292, 520, 523, 459–461, 200/526
See application file for complete search history.

(56) References Cited

U.S. PATENT DOCUMENTS

| | | | | |
|---|---|---|---|---|
| 4,447,681 | A * | 5/1984 | Desmarais | 200/5 A |
| 5,296,826 | A | 3/1994 | Hart et al. | |
| 5,659,162 | A | 8/1997 | Hart | |
| 6,153,841 | A | 11/2000 | Hart | |
| 6,542,056 | B2 * | 4/2003 | Nerstrom et al. | 335/17 |
| 6,667,451 | B1 | 12/2003 | Hart | |
| 6,770,829 | B1 * | 8/2004 | Hart | 200/314 |
| 7,504,597 | B2 * | 3/2009 | Shimazu et al. | 200/43.04 |
| 8,017,883 | B2 * | 9/2011 | Kiyono et al. | 200/520 |

* cited by examiner

*Primary Examiner* — Edwin A. Leon
*Assistant Examiner* — Anthony R. Jimenez
(74) *Attorney, Agent, or Firm* — Paul D. Chancellor; Ocean Law

(57) ABSTRACT

An electromechanical switch includes a contact assembly and a linkage assembly.

4 Claims, 14 Drawing Sheets

LOW PROFILE SWITCH

PRIORITY CLAIM

This application claims priority to U.S. Provisional Application No. 61/349,200 filed May 27, 2010 and entitled LOW PROFILE SWITCH.

BACKGROUND OF THE INVENTION

1. Field of the Invention

The present invention relates to electromechanical switches. In particular, a pushbutton switch includes a mechanical linkage and an electrical contact for use in an electrical circuit.

2. Discussion of the Related Art

Pushbutton switches are well known in the electromechanical arts. Pushbutton switch designs have typically focused on cost, functionality, voltage rating, and current rating. However, some pushbutton switch designs meet more comprehensive specifications, such as high reliability and usability, taking into account, among other things, the switch operating environment and human factors.

High performance switches are often found in mission critical systems. For example, pushbutton switches used in aircraft may implement control functions for essential equipment such as landing gear, fuel tanks, lighting, emergency beacons, and communications.

Switch geometry must provide sufficient space for implementing switch functions in mechanical, optical, and electrical hardware. Proliferation of control functions in aircraft and other control systems has led to proliferation of control elements including switches. For example, an aircraft control panel might include tens or hundreds of switches. Space for these control elements may be constrained where control panel space is limited.

Despite the case for developing smaller high performance switches, the switch industry has been slow to offer new, more compact switch designs. Tending to dissuade development of new compact designs able to meet stringent specifications, such as aerospace and military specifications, is the high cost and risk associated with new switch development. And encouraging reliance on old, less compact designs is the preference for switches with long histories of successful operating experience.

SUMMARY OF THE INVENTION

The present invention provides an electromechanical switch including contact assembly and a linkage assembly in a low-profile arrangement. In an embodiment: A contact assembly is located at least partially between a pushbutton, and a base; the contact assembly includes a contact arm, first and second spacers, and a pivot post; the pushbutton is operative to select from among a plurality of contact arm states; the first spacer pivotally engages the pivot post and the contact arm; the second spacer pivotally engages the pivot post and the contact arm; the second spacer includes a spacer spring, a spacer spring insert, and a piston; the piston is for moving in an elongated cavity of the spacer spring insert; and, the pushbutton is operable to store energy in and to withdraw energy from the spacer spring while moving the contact arm between first and second equilibrium states.

In an embodiment, the switch includes: A linkage assembly including a link operable to transfer forces between a contact arm and an actuator lever; the linkage assembly further includes a retainer operable to transfer forces between the actuator lever and the pushbutton; and, an actuator lever biasing spring tends to resist depression of the pushbutton.

In an embodiment, the electromechanical switch includes: A cam adjacent to the link; a cam follower extending from the link; the cam follower is operative to engage a curvilinear surface of the cam; and, interaction between the cam follower and the cam curvilinear surface creates a plurality of pushbutton equilibrium states.

These and other embodiments of the electromechanical switch of the present invention are described below.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of the embodiments they disclose. For example, other embodiments of the disclosed device and/or method may or may not include the features described herein. Moreover, disclosed advantages and benefits may apply to only certain embodiments of the invention and should not be used to limit the disclosed invention.

As used herein, the term "coupled" includes direct and indirect connections. Moreover, where first and second devices are coupled, intervening devices including active and/or passive devices may be located therebetween.

Figure 1:
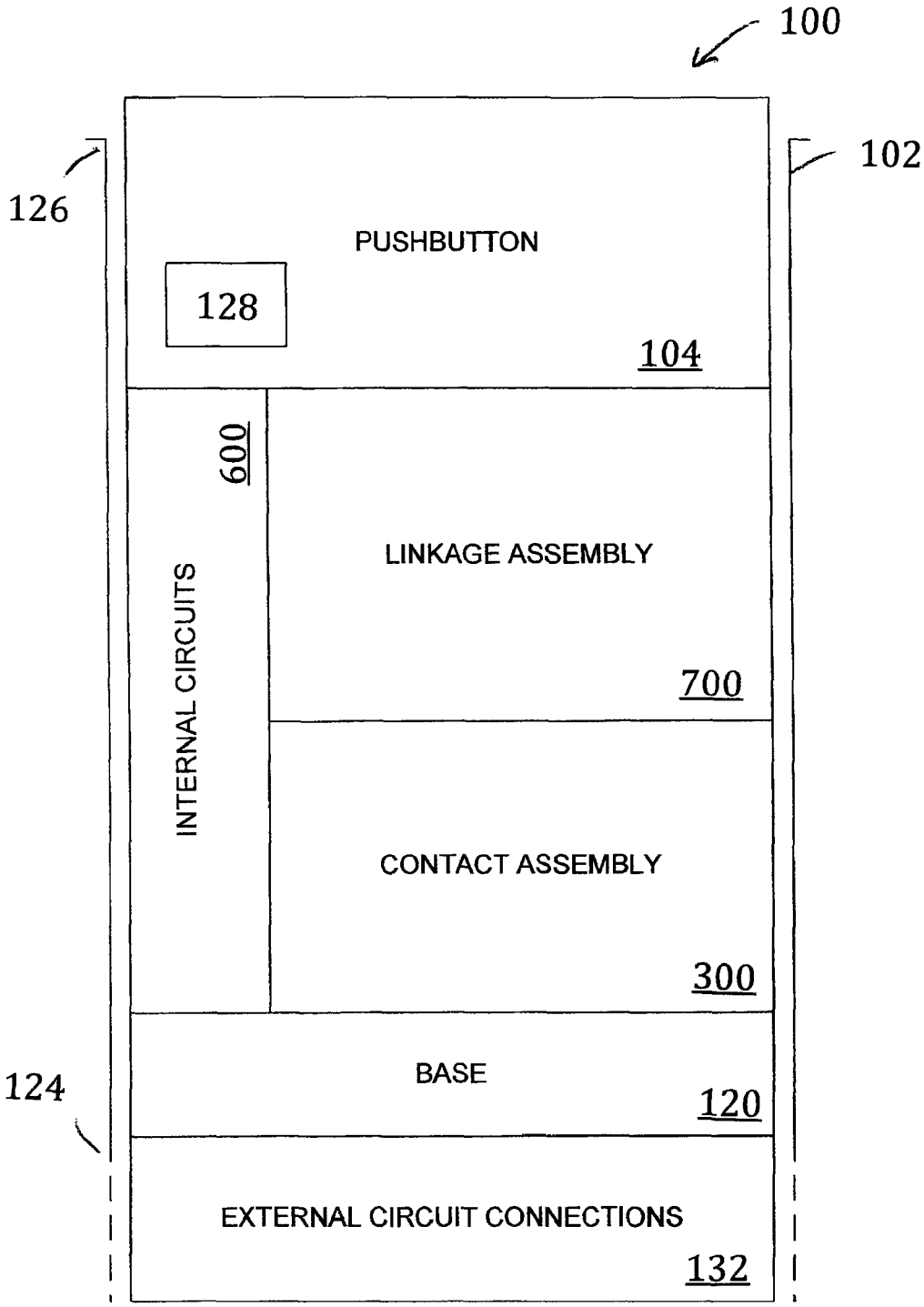
FIG. 1 shows a schematic diagram of an electromechanical switch in accordance with the present invention.

FIGS. 1-8 illustrate embodiments of the present invention. FIG. 1 shows a schematic diagram of an electromechanical switch 100 in accordance with the present invention. The switch includes a linkage assembly 700, a contact assembly 300, internal circuits 600, and an optional outer shell 102.

External circuit connections 132 are in various embodiments enclosed, partially enclosed or not enclosed by a shell. A base 120 is located near a first end of the switch 124 and a pushbutton 104 is located near a second end of the switch.

Some embodiments include a means for lighting the pushbutton, such as light emitting diodes 128.

Figure 2:
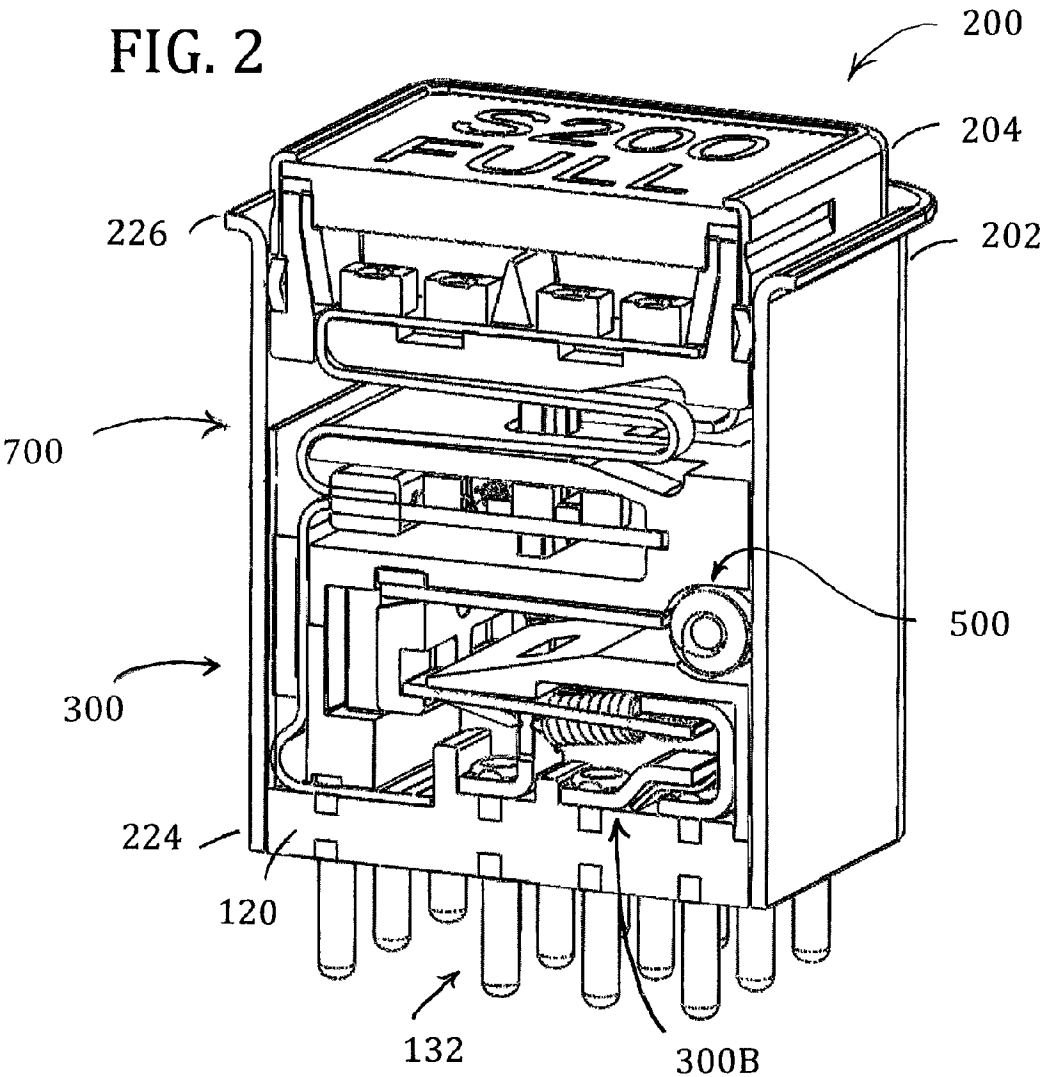
FIG. 2 shows a schematic cut-away of the switch of FIG. 1 above.

FIG. 2 shows a schematic cutaway of an assembled switch 200. Located substantially between a pushbutton 204 and a base 120 is a contact assembly 300 and a linkage assembly 700. In an embodiment, an outer shell 202 surrounds a base at a first end of the switch 224 and surrounds a pushbutton 204 at a second end of the switch 226. Internal circuits 600 (see FIG. 6) are located at least in part between the pushbutton and the base. Circuit connections, such as terminals extending from the base, provide a means 132 for interfacing the switch 100 with an external circuit.

Figure 3A:
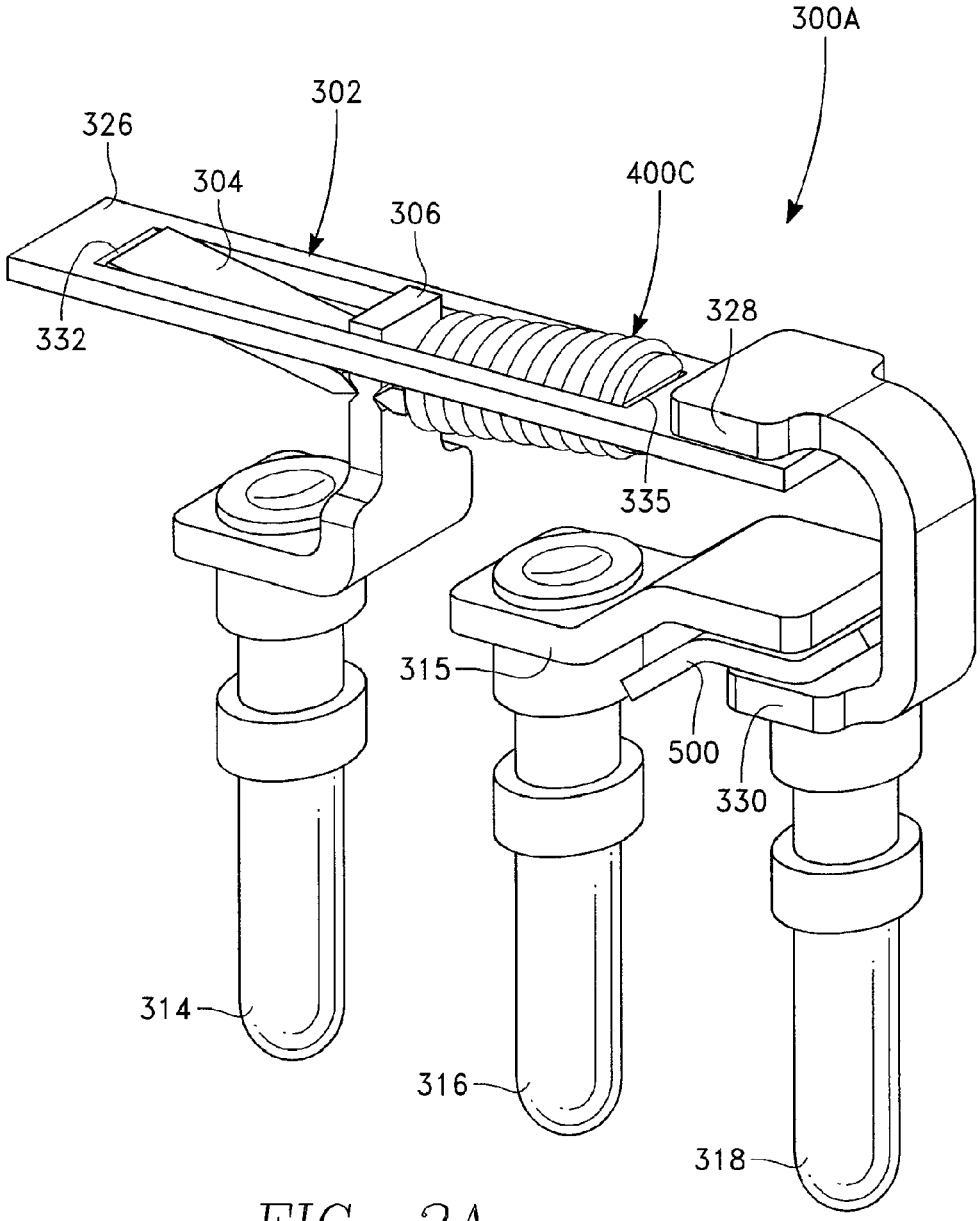
FIGS. 3A-B show contact assemblies of the switch of FIG. 1 in alternative states.
Figure 3B:
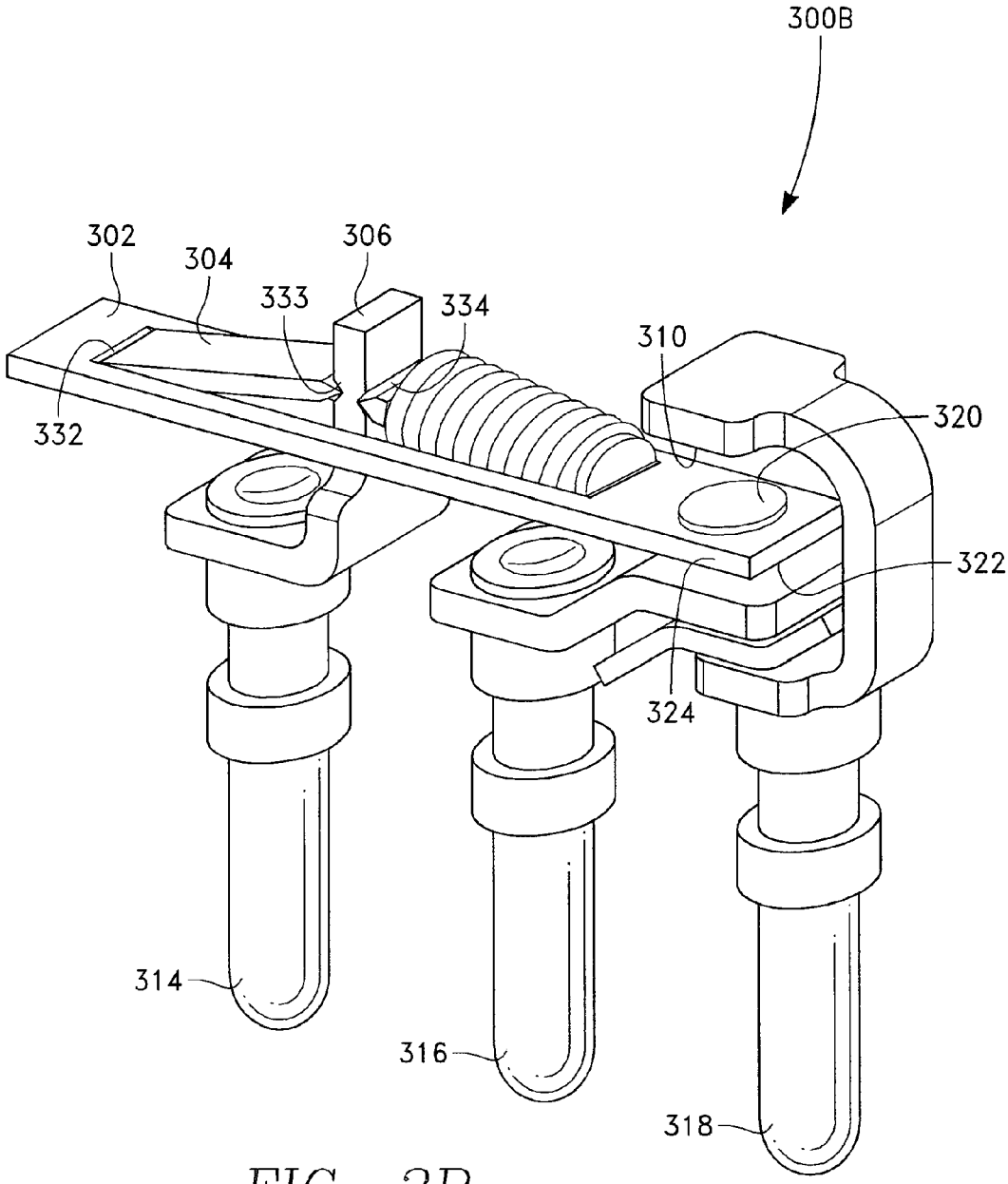

FIGS. 3A and 3B show a contact assembly in alternate states 300A, 300B. The contact assembly includes a contact arm 302 spaced apart from a pivot post 306 by first and second spacers 304, 400C. The first spacer is pivotally engaged at opposed ends with the contact arm and the pivot post 332, 333 and the second spacer is pivotally engaged at opposed ends with the pivot post and the contact arm 334, 335. Pivots include any suitable pivots known to persons of ordinary skill in the art, such as ball and socket, hinge, and chisel and groove type pivots (as shown).

Figure 8A:
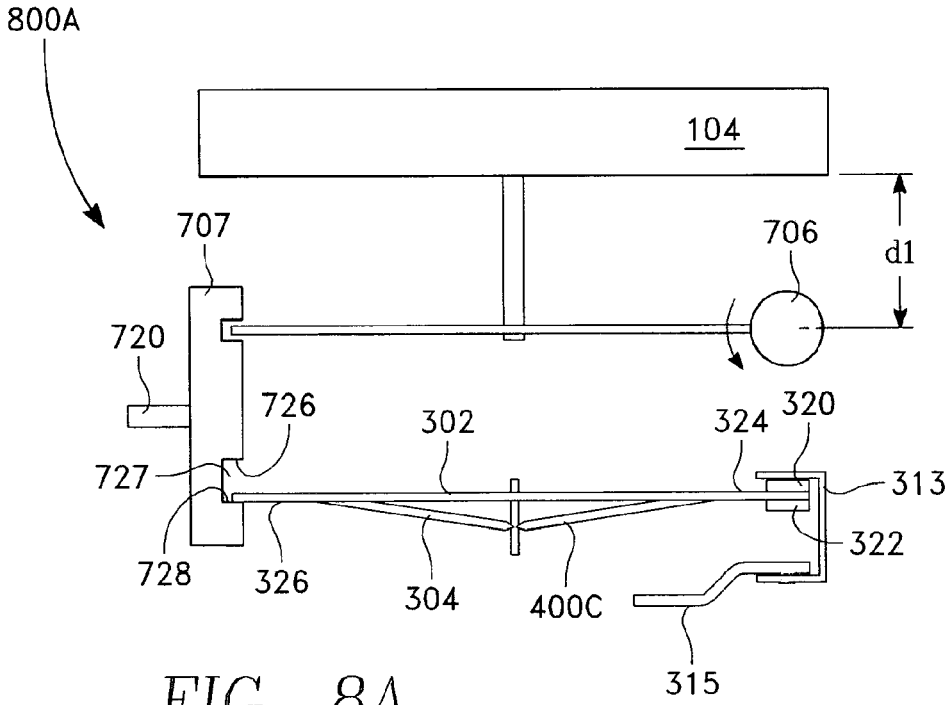
FIGS. 8A-8D show illustrations of relative positions of the linkage of the switch of FIG. 1.
Figure 8B:
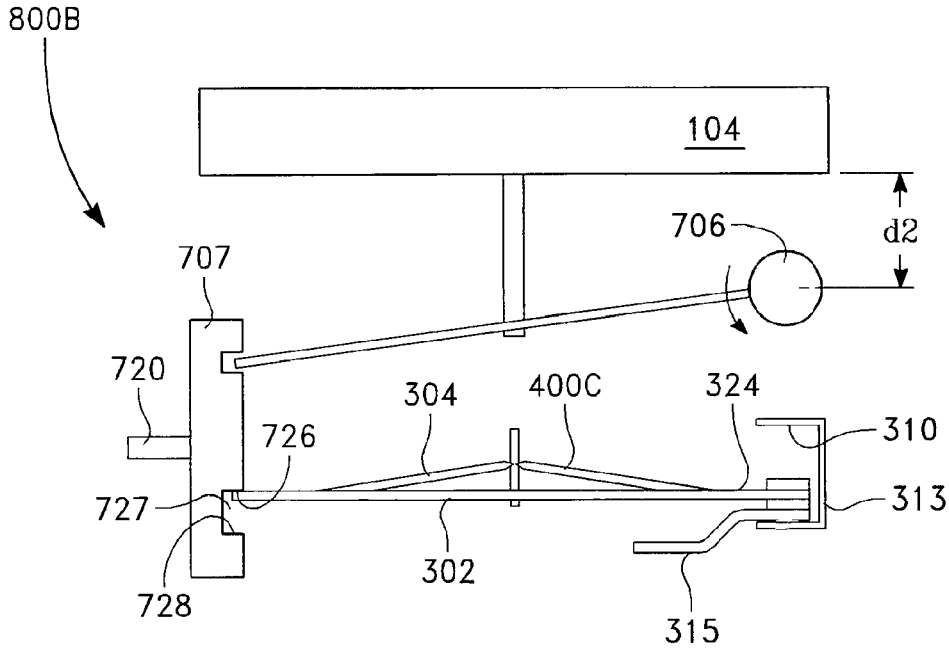
Figure 8C:
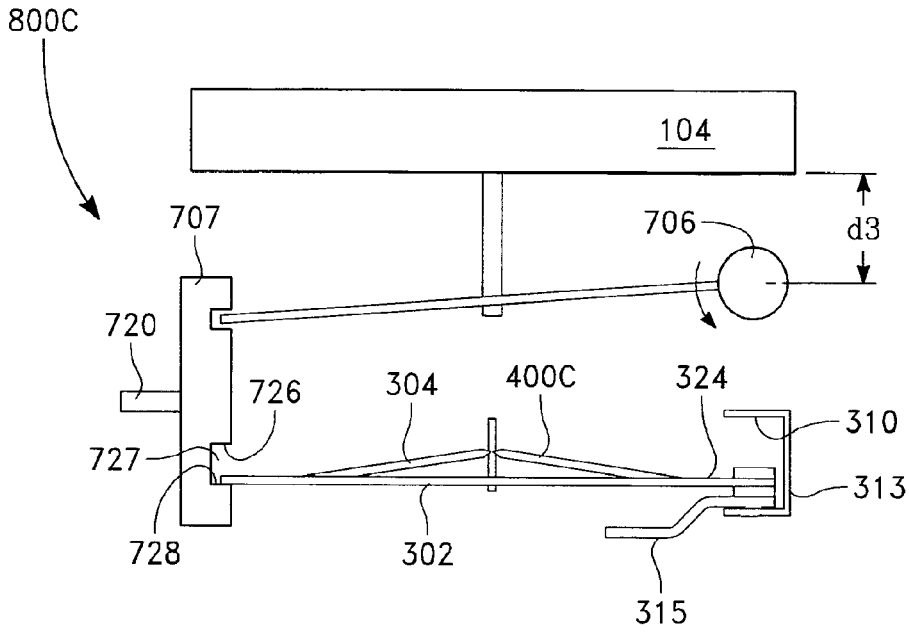
Figure 8D:
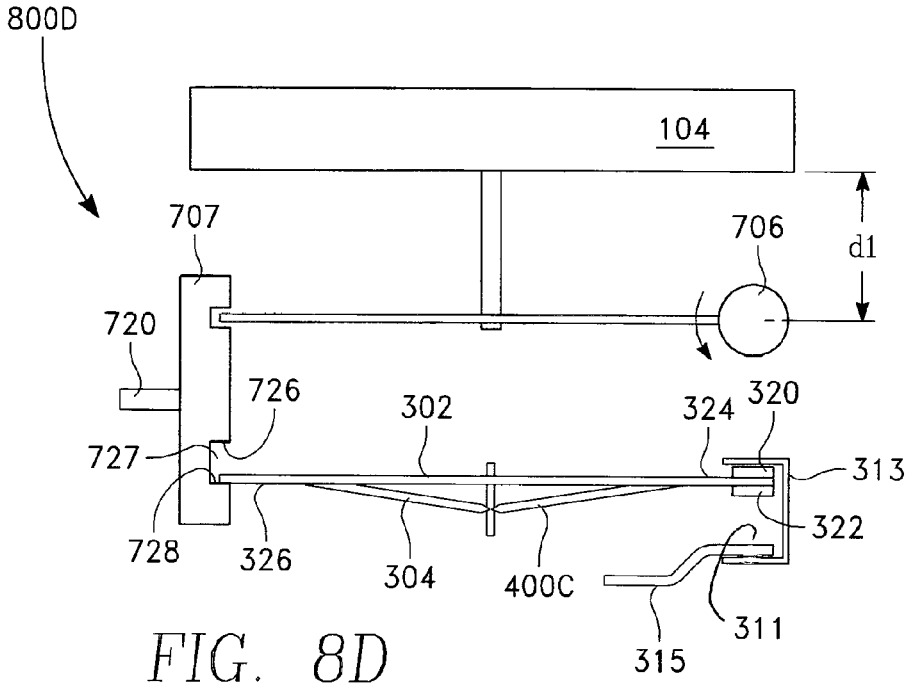

Upper and lower contacts 320, 322 at a first end of the contact arm 324 are for mating with respective upper and lower stationery contacts 310, 311 (see also FIG. 8D). Terminals 314, 316, 318 connect respectively with the pivot post, an "S" shaped conductor 315 including the lower stationery contact 311, and a "C" shaped contact 313 (see also FIG. 8A) having upper and lower upper and lower extensions 328, 330. Notably, the contact end of the "S" shaped conductor protrudes into the mouth of the "C" shaped contact. In some embodiments, an electrical insulator that may also be designed as a mechanical damper 500 is inserted in a gap between the lower extension 330 and the stationery contact 311 (as shown). And, in some embodiments, an air gap is an insulator between the lower extension and the stationery contact 311.

Figure 4A:
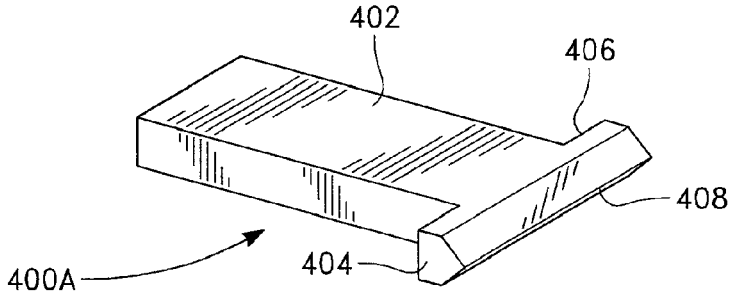
FIGS. 4A-C shows a spacer of the switch of FIG. 1.
Figure 4B:
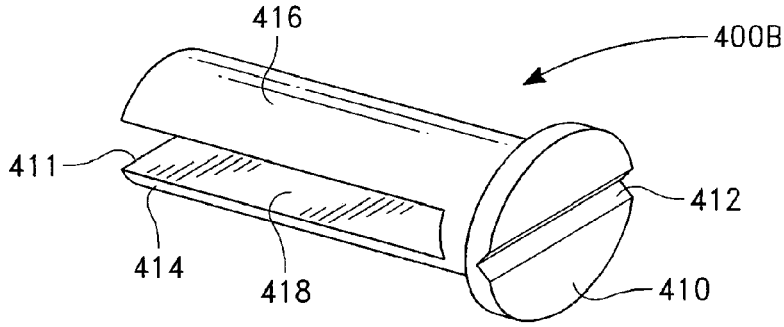
Figure 4C:
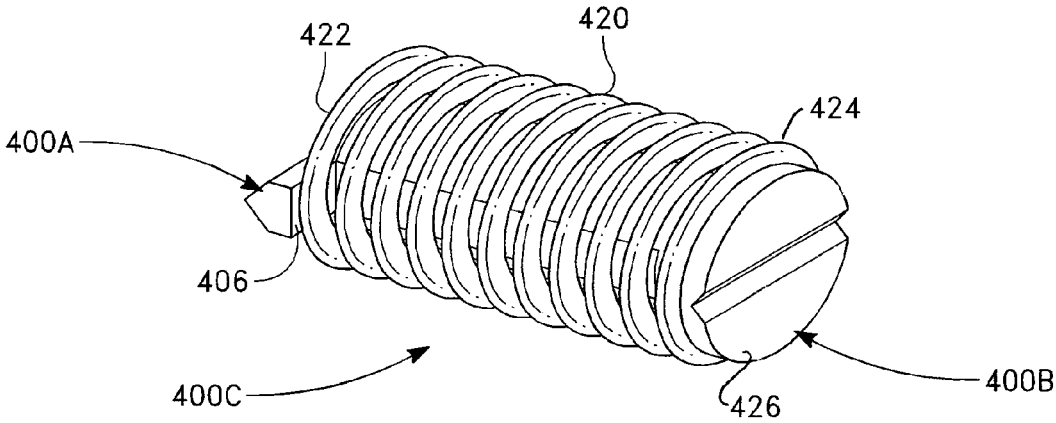

FIGS. 4A-C illustrate the second spacer 400A-C. FIG. 4A shows a piston of the second spacer 400A. The piston includes a piston shank 402, a piston head 404 with piston head shoulders 406 overhanging the shank, and a chisel-like forward edge of the piston head 408.

FIG. 4B shows a spring insert of the second spacer 400B. The spring insert includes a body 414 with an end 411 bifurcated by an elongated slot 418 defined by generally opposed slot sidewalls 414, 416. Opposite the body's bifurcated end is a capped end 410 with a pivot groove in its face about normal to the body's major axis 412.

FIG. 4C shows the assembled second spacer 400C. Here, the spring insert 400B is inserted in a compression spring 420 and the piston shank 402 is inserted in the elongated slot 418 of the spring insert. One end of the spring 424 rests at least partially against an overhanging lip of the capped end 426 and the opposite end of the spring 422 rests at least partially against a shoulder 406 of the piston head. Free to move within the elongated slot, the piston head 404 and capped end 410 spacing determine the compression of the spring.

The first and second spacers are, in an embodiment, made of heat treated beryllium copper for electrical conductivity. The second spacer 400C serves as a spring guide, resisting spring buckling. In an embodiment, each spacer has a knife edge pivot at one end and a grove pivot at the opposed end; complementary pivots are provided by the pivot post grooves and contact arm chisel edges. Here, the pivot design including a compression spring provides a low profile and enhances contact electrical conductivity.

Figure 5:
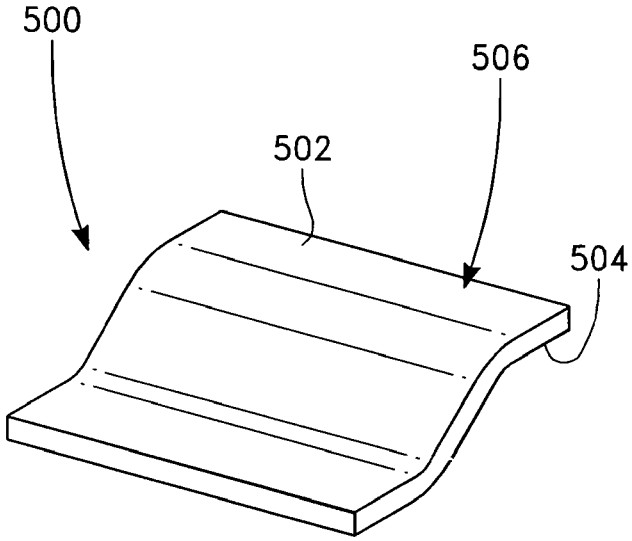
FIG. 5 shows an insulator of the switch of FIG. 1.

FIG. 5 shows an enlarged schematic view of electrical insulator 500. In an embodiment, the electrical insulator 502 is made of a thermally conductive material such as a suitable rubber. In some embodiments, one or both of opposed major electrical insulator surfaces 504, 506 are metalized with gold, nickel, or another suitable metal to reduce thermal resistance. These features promote conduction heat transfer from the contacts, for example contacts 311, 322, through the electrical insulator to the terminal 316.

In an embodiment, the electrical insulator 500 is selected to provide support/mechanical dampening of the lower stationery contact 311. The dampening reduces contact bounce ("ringing"), which increases contact life and electrical load capacity. Thermal coupling provides parallel heat sink paths, which lowers switch compartment temperature thereby increasing contact life and electrical load capacity.

Figure 6:
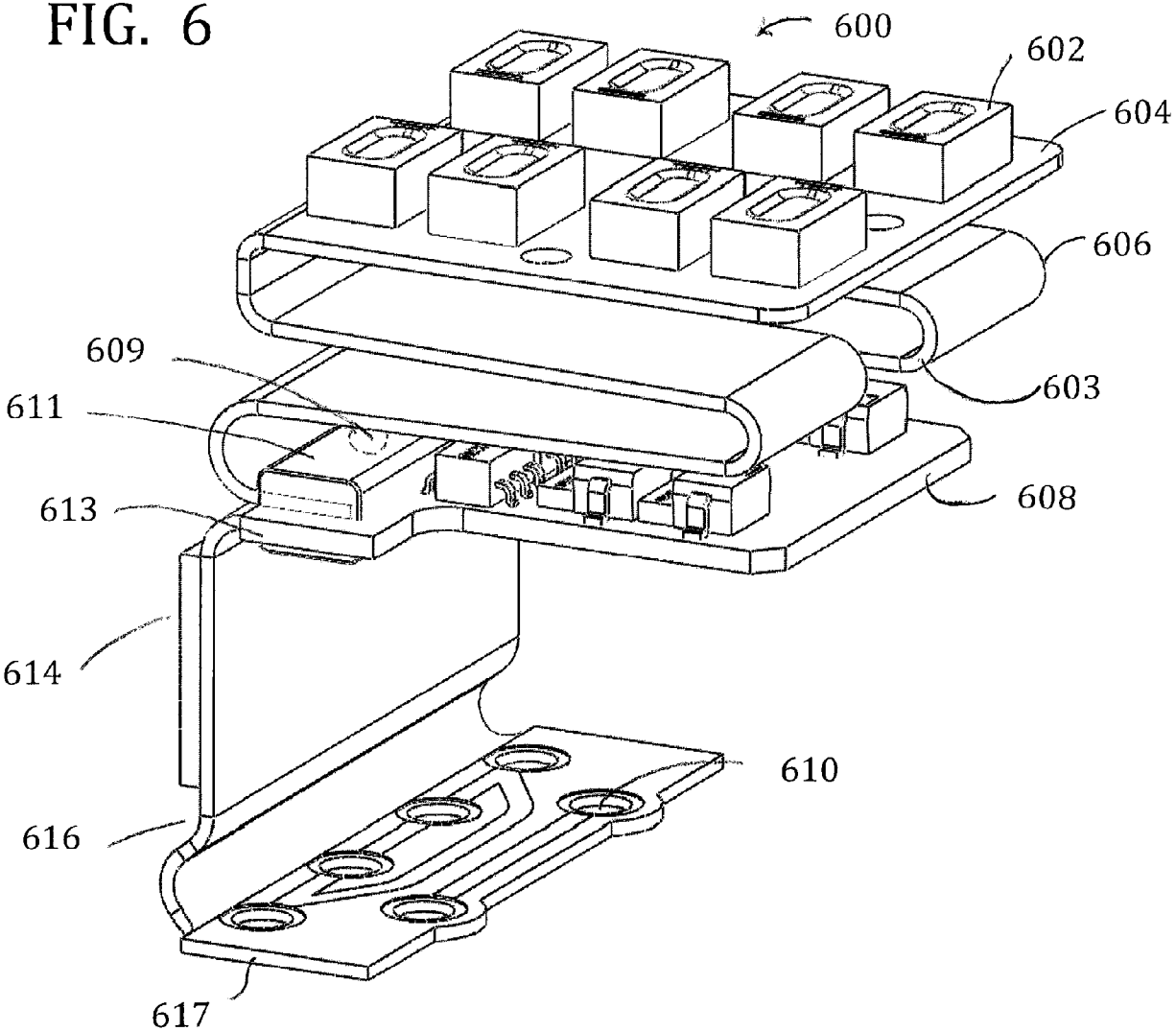
FIG. 6 shows internal circuits of the switch of FIG. 1.

FIG. 6 shows switch internal circuits 600. A length of flexible, printed circuit 606 has a slotted portion 603 and interconnects with one or more light sources 602 located on a first extended section of the flexible printed circuit 604. A second extended section of the flexible printed circuit 611 engages, such as via conductive rivets or similar devices 609, and establishes electrical continuity with circuits in a connecting portion of a rigid printed circuit 613.

A riser portion of the rigid printed circuit 616 couples the connector portion 613 with a base portion of the rigid printed circuit 617. Means for connecting circuits in the base portion of the rigid printed circuit include through holes 610 used in conjunction with rivets or terminals fixed in the base 120.

In some embodiments, internal circuits 600 include discrete devices for supporting and/or managing electrical loads such as light sources. In an embodiment, an extended portion of the rigid printed circuit board 608 provides electrical connections and support for discrete devices. And, in some embodiments, the riser portion 616 of the rigid printed circuit board 616 provides a surface for mounting electrical devices. In an embodiment, a resistor or another heat generating device 614 is mounted to the riser such that switch internals are shielded from device generated heat by the interposed rigid printed circuit board. And, in an embodiment, device heat is dissipated via either free surface convection or conduction through an outer shell 102 pressed against the resistor.

Figure 7A:
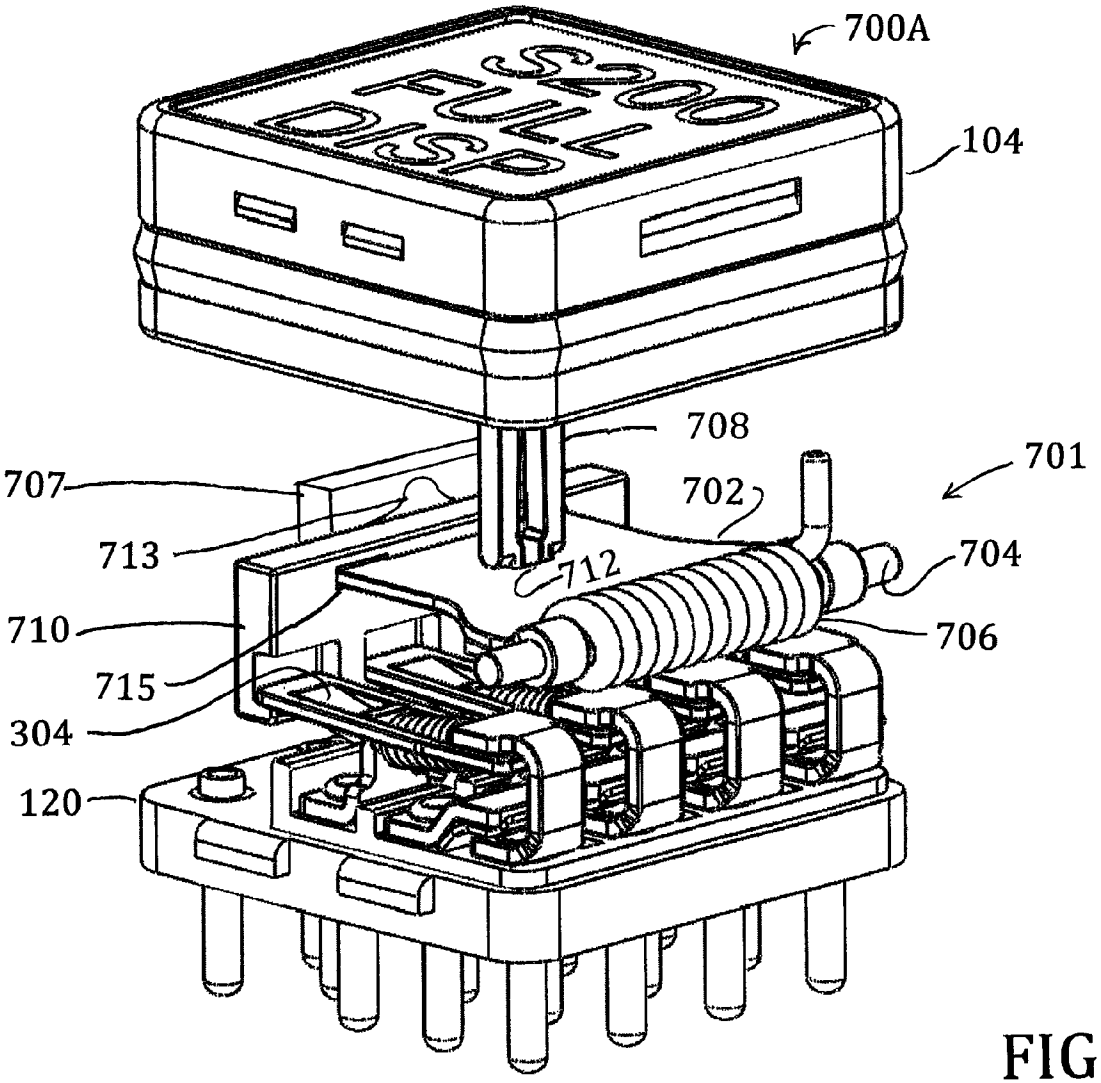
FIG. 7A shows switch parts including a linkage of the switch of FIG. 1.

FIG. 7A shows switch parts including a linkage assembly 700A. The linkage assembly 701 includes a retainer 708 coupling the pushbutton 104 to an actuator lever 702 and a link 710 coupling the actuator lever to the contact assembly contact arm(s) 302 (see also FIG. 3A). The actuator lever is rotatable about an actuator lever shaft 704 positioned above the stationary switch contacts 313 (see also FIG. 8B).

An actuator lever biasing spring 706 encircles the actuator lever shaft and engages and causes the actuator lever to resist depression of the switch. As will be obvious to persons of ordinary skill in the art, other suitable springs and spring arrangements may be used in other embodiments to accomplish the purpose of this actuator spring.

Figure 7B:
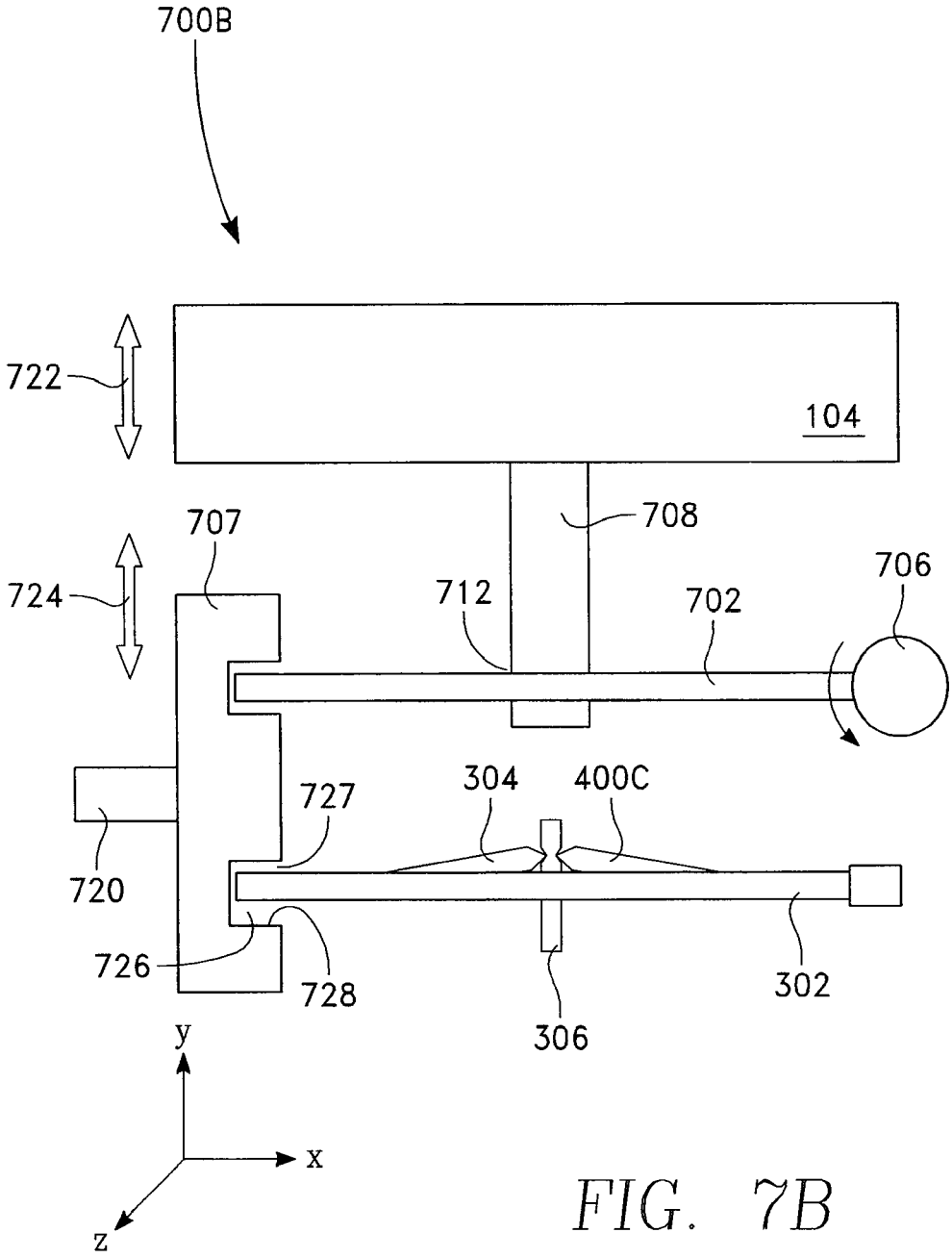
FIG. 7B shows a schematic view of a linkage assembly of the switch of FIG. 1.

FIG. 7B shows a schematic view of the linkage assembly 700B. In this view the spring 420 associated with the second spacer 400C is omitted for clarity.

Referring to FIGS. 7A-B, a cam 707 is located adjacent to the link 710 and a cam follower 720 coupled to the link engages a curvilinear surface 713 of the cam (cam shown moved away from link for illustrative purposes). As shown, moving the pushbutton in a direction parallel to the y-axis 722 causes a) rotation of the actuator lever 702 about an axis parallel to the z-axis and b) translation of the link 724, via an actuator lever/upper link slot engagement 725, in a direction parallel to the y-axis. As will be further described below, motion of the cam follower 720 causes translation of the cam 707 in a direction parallel to the z-axis.

Figure 7C:
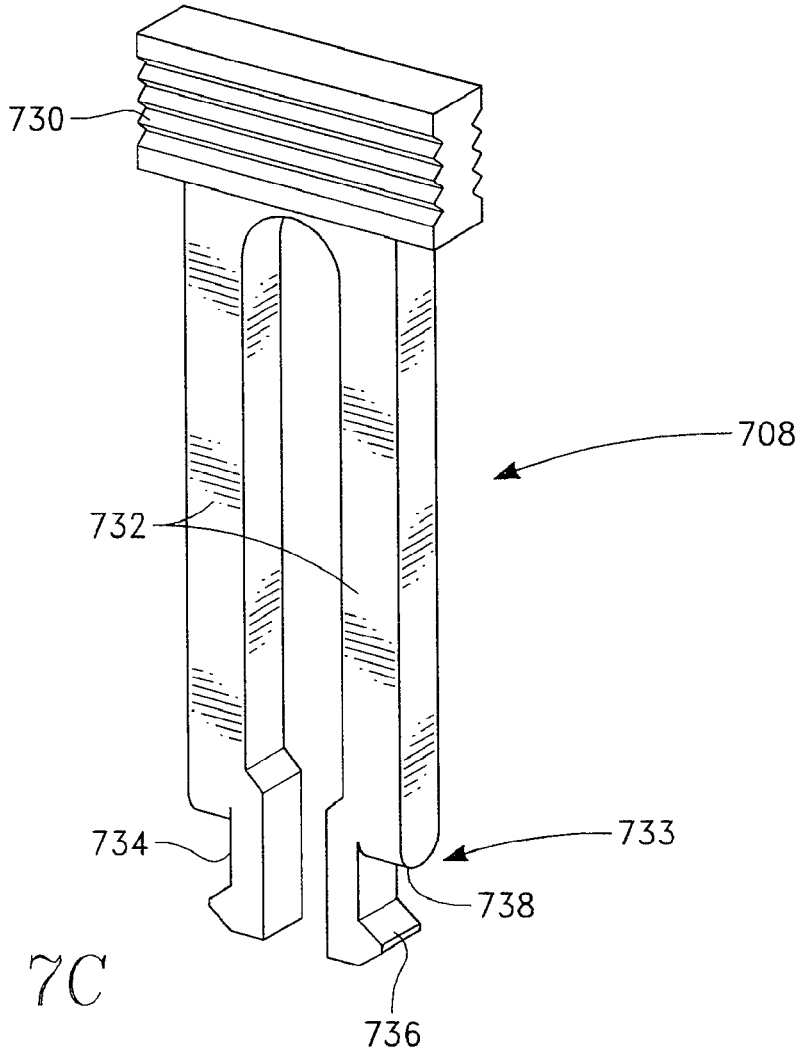
FIG. 7C shows an enlarged view of a retainer of the switch of FIG. 1.

FIG. 7C shows an enlarged view of the retainer 708. A first retainer end 730 is for engaging the pushbutton 104 and a second retainer end 733 is for engaging the actuator link 702. The first retainer end may be molded in, snap fitted to, adhesively affixed to, hinged with, or otherwise coupled with the pushbutton.

The second retainer end 733 engages the actuator link 702 at a location between the actuator spring and an actuator tab(s) 715 for insertion in the link 710. In various embodiments, the retainer is removably fitted to the actuator link.

In an embodiment, a spring form body 732 joins the first and second retainer ends 730, 733. Compression of the spring form body reduces the profile of the second end 733 such that it is removable from a cut-out in the actuator link 712. In some embodiments, the retainer includes generally opposed catches 736 adjacent to reliefs 734 near the second retainer end.

Figure 7D:
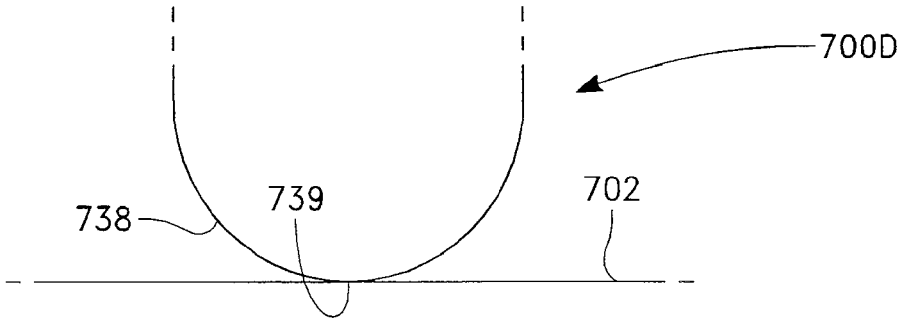
FIG. 7D shows an enlarged view of a portion of the second retainer end of a retainer of the switch of FIG. 1.

FIG. 7D shows an enlarged view of a portion of the second retainer end 700D. In this embodiment, a curved surface of the second retainer end 738 provides for engaging the actuator link 702. As the pushbutton is depressed, the actuator lever pivots about its shaft 704 such that the curved surface of the second retainer end is in rolling contact 739 with the actuator lever. Among other things, this arrangement provides smooth operation and reduces wear commonly associated with articulated switch linkages.

FIGS. 8A-D are schematic illustrations of an embodiment of the switch showing relative positions of an exemplary linkage during operation of the switch 800A-800D. FIGS. 9A-D are corresponding schematic illustrations showing relative positions of an exemplary cam and cam follower during operation of the switch 900A-900D. In an embodiment, these figures represent a set or sequence of switch states.

Figure 9A:
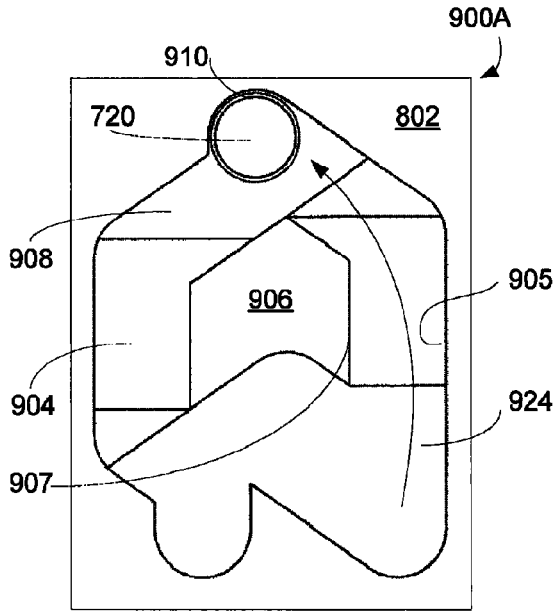
FIGS. 9A-9E show illustrations of a cam including relative positions of the cam and a cam follower during operation of the switch of FIG. 1.
Figure 9B:
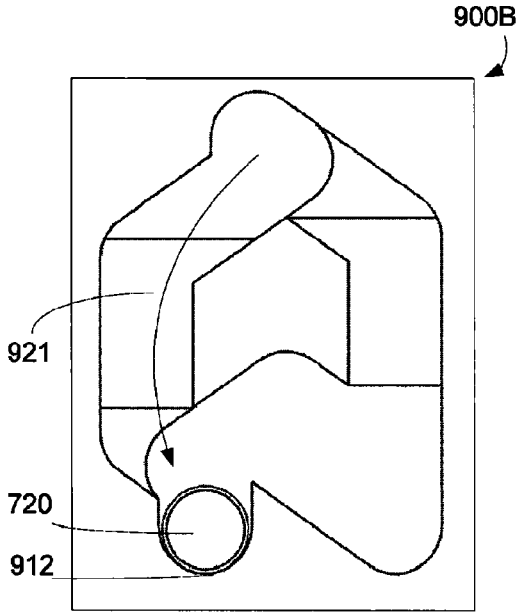
Figure 9C:
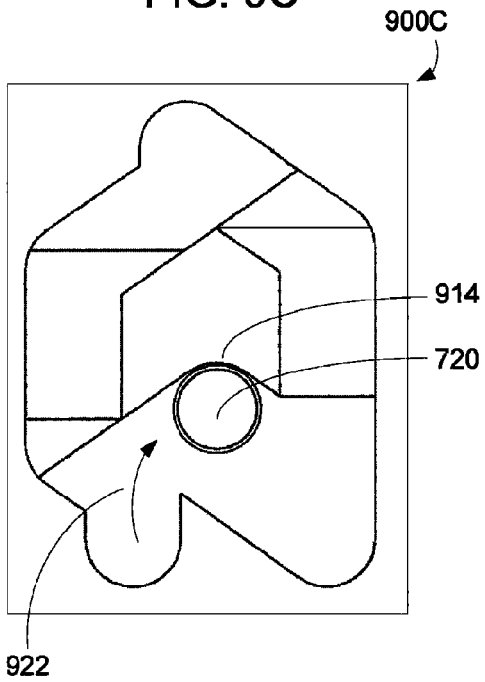
Figure 9D:
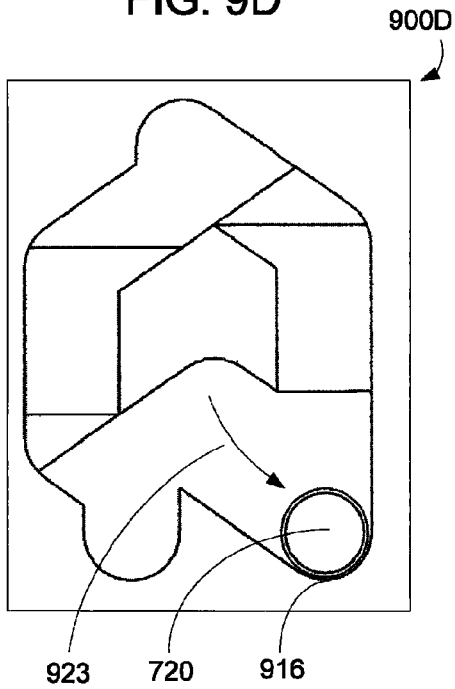
Figure 9E:
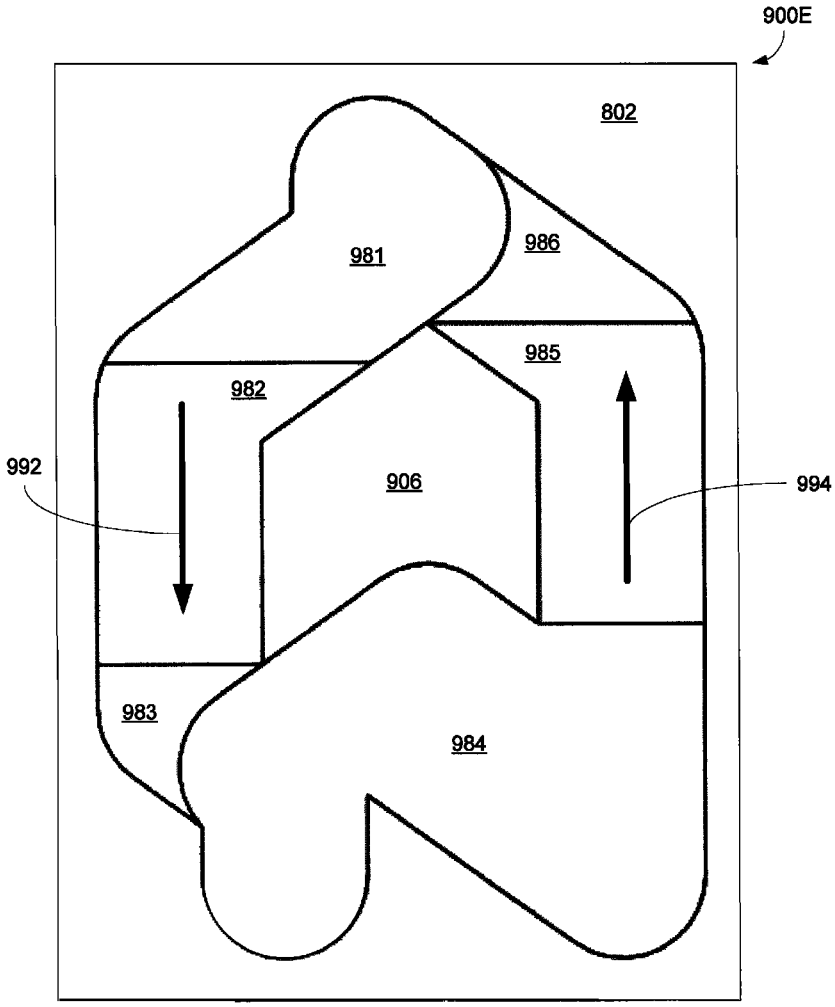

FIG. 9E is a schematic illustration of an embodiment of the switch indicating the cam profile 900E. In particular, this figure shows a cam body 802 with a central deflector 906 surrounded by contiguous zones excavated from the cam body 981, 982, 983, 984, 985, and 986. The first zone 981 is a first pit zone at a first pit elevation. The second zone 982 is a first rising ramp zone as indicated by the ramp arrow 992. The third zone 983 is a first landing zone. The fourth zone 984 is a second pit zone at a second pit elevation below the first landing elevation. The fifth zone 985 is a second rising ramp zone as indicated by the ramp arrow 994. The sixth zone 986 is a second landing zone above the first pit elevation. As can be seen, a cam follower inserted in the excavated portion of the cam rises and falls as it traverses the route surrounding the deflector.

While seated in the first pit zone 981, the follower 720 is in an initial rest position. When the pushbutton is depressed, the follower rises in moving from the first pit zone to the first landing zone 983 via the first ramp zone 982; falls in moving from the first landing zone to the second pit zone 984; rises in moving from the second pit zone to the second landing zone via the second ramp zone 985; and, falls in moving from the second landing zone 986 to the first pit zone 981.

In various embodiments, operation of the switch pushbutton 104 causes the follower 720 to move around the deflector 906 in a generally counterclockwise direction as described below. Because the follower is urged to press against the floor of each zone 981-986, it "falls" off the first landing when moving to the second pit and is unable to reverse its path at that point; a "commit-to-latch position." In a similar fashion, as the follower circumnavigates the deflector, it falls a second time when moving from the second landing to the first pit and is again unable to reverse its path at that point; a "full travel commit-to-latch position." In some embodiments, the first pit zone and the second pit zone 981, 984 are at about the same elevation and in some embodiments the first landing and the second landing 983, 986 are at about the same elevation.

FIG. 8A shows the switch linkage in an initial rest state 800A. The pushbutton 104 is fully extended as indicated by pushbutton projection d1. As shown here, the pushbutton projection is the distance between the movable pushbutton and the stationery center of a torsion spring 706. In this state, a) the contact arm second end 326 (see also FIG. 3A) bears against a lower shoulder 728 of a lower slot 727 in the link 707 and b) the moving contact 320 bears against the upper stationery contact 310. Notably, the spacers 304, 400C are generally below the contact arm in this state.

FIG. 9A shows the cam and cam follower in an initial rest position 900A corresponding to switch linkage state 800A. A cam body 802 includes a cut-out area 904 defining a curvilinear surface 905. A deflector 906 is surrounded by the curvilinear surface. The space between a boundary of the deflector 907 and the curvilinear surface define a route or track 908 around the deflector. In the initial rest position, the cam follower 720 is seated in an upper pocket 910 defined by the curvilinear surface.

FIG. 8B shows the switch linkage in a first commit-to-latch state 800B. Here, the pushbutton is depressed as indicated by the pushbutton projection d2<d1. In this state, a) the contact arm second end 326 (see also FIG. 3A) is forced downward by an upper shoulder 726 of the lower slot 727 in the link 707 and b) the moving contact 322 bears against the lower stationery contact 311. Notably, the spacers 304, 400C are generally above the contact arm in this state.

FIG. 9B shows the cam and cam follower in a first commit-to-latch position 900B corresponding to switch linkage state 800B. In moving from the initial state to the first commit-to-latch position, the cam follower 720 moves from the first pocket 910 along a path 921 around the deflector 906 and moves into a second pocket 912 along a lower portion of the curvilinear surface 905.

FIG. 8C shows the switch linkage in a latched state 800C. Here, the pushbutton 104 has been released and rises to an intermediate projection d3>d2. In this state, a) the contact arm second end 326 bears against the lower shoulder 728 of the lower slot 727 in the link 707 and b) the moving contact 322 continues to bear against the lower stationery contact 311.

FIG. 9C shows the cam and cam follower in latched position 900C corresponding to the switch linkage state 800C. In moving from the commit-to-latch position 900B to the latched position 900C, the cam follower 720 moves along a path 922 from the second pocket 912 to a third pocket along a lower portion of the boundary of the deflector 914.

Depressing and releasing the pushbutton 104 when the switch is in the latched state 800C, 900C causes the switch to transition from the latched state back to the initial state 800A, 900A. During this transition, the follower 720 moves along path 923 to a lower pocket 916 and then along a path 924 returning the follower to the upper pocket 910.

FIG. 9D shows the cam and cam follower in a full travel commit-release position 900D that is achieved by depressing the pushbutton. The full travel commit-release position corresponds to a switch linkage state similar to 800B. In moving from the latched state 900C to the latch release state 900D, the cam follower 720 moves from the third pocket 914 to a fourth pocket along a second lower portion of the curvilinear surface

916. Releasing the pushbutton causes a) the cam follower to move from the fourth pocket 916 along a path 924 to the first pocket 910 as shown in FIG. 9A and b) the switch linkage to return to its initial state 800A as shown in FIG. 8A.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. An electromechanical switch comprising:

a contact assembly located at least partially between a pushbutton, and a base;

the contact assembly including a contact arm, first and second spacers, and a pivot post;

the pushbutton operative to select from among a plurality of contact arm states;

the first spacer pivotally engaging the pivot post and the contact arm;

the second spacer pivotally engaging the pivot post and the contact arm;

the second spacer including a spacer spring, a spacer spring insert, and a piston;

the piston for moving in an elongated cavity of the spacer spring insert;

the pushbutton operable to store energy in and to withdraw energy from the spacer spring while moving the contact arm between first and second equilibrium states;

a linkage assembly including a link operable to transfer forces between a contact arm and an actuator lever;

the linkage assembly further including a retainer operable to transfer forces between the actuator lever to the pushbutton;

an actuator lever biasing spring tending to resist depression of the pushbutton;

a cam adjacent to the link;

a cam follower extending from the link;

the cam follower operable to engage a curvilinear surface of the cam;

interaction between the cam follower and the cam curvilinear surface creating a plurality of pushbutton equilibrium states;

wherein operation of the pushbutton causes the link and cam to move, the link moving in a direction about perpendicular to the cam's direction of motion;

wherein the spacer spring is a compression spring and the actuator lever biasing spring is a torsion spring; and, a retainer curved surface for engaging the actuator lever, rolling contact between the retainer curved surface and an actuator lever surface being caused by depression of the pushbutton.

2. The electromechanical switch of claim 1 further including a retainer release operable to decouple the retainer and pushbutton from the actuator lever.

3. The electromechanical switch of claim 1 further including: a retainer release with generally opposed catches fitted to a spring form portion of the retainer; and, the retainer release operable to decouple the retainer and pushbutton from the actuator lever.

4. An electromechanical switch comprising:

a contact assembly located at least partially between a pushbutton, and a base;

the contact assembly including a contact arm, first and second spacers, and a pivot post;

the pushbutton operative to select from among a plurality of contact arm states;

the first spacer pivotally engaging the pivot post and the contact arm;

the second spacer pivotally engaging the pivot post and the contact arm;

the second spacer including a spacer spring, a spacer spring insert, and a piston;

the piston for moving in an elongated cavity of the spacer spring insert;

the pushbutton operable to store energy in and to withdraw energy from the spacer spring while moving the contact arm between first and second equilibrium states;

a linkage assembly including a link operable to transfer forces between a contact arm and an actuator lever;

the linkage assembly further including a retainer operable to transfer forces between the actuator lever to the pushbutton;

an actuator lever biasing spring tending to resist depression of the pushbutton; and, a retainer curved surface for engaging the actuator lever, rolling contact between the retainer curved surface and an actuator lever surface being caused by depression of the pushbutton.

* * * * *